US009249595B1

(12) United States Patent
Reski

(10) Patent No.: US 9,249,595 B1
(45) Date of Patent: Feb. 2, 2016

(54) FOLDING TOWER POLE ASSEMBLIES

(71) Applicant: Great Plains Towers, Inc., West Fargo, ND (US)

(72) Inventor: Kevin Francis Reski, Horace, ND (US)

(73) Assignee: GREAT PLAINS TOWERS, INC., West Fargo, ND (US)

( * ) Notice: Subject to any disclaimer, the term of this patent is extended or adjusted under 35 U.S.C. 154(b) by 0 days.

(21) Appl. No.: 14/667,927

(22) Filed: Mar. 25, 2015

Related U.S. Application Data

(60) Provisional application No. 61/974,160, filed on Apr. 2, 2014.

(51) Int. Cl.
*E04H 12/18* (2006.01)
*E04H 12/34* (2006.01)

(52) U.S. Cl.
CPC ..... *E04H 12/187* (2013.01); *E04H 12/345* (2013.01)

(58) Field of Classification Search
CPC ..... E04H 12/187; E04H 12/345; E04H 12/18; E04H 12/228; E21B 7/023
USPC ..... 52/116; 269/37, 40, 41; 248/519, 523; 212/294, 299, 300
See application file for complete search history.

(56) References Cited

U.S. PATENT DOCUMENTS 848,304 A * 3/1907 Hines ..... E21B 15/00 212/177
1,758,453 A 5/1930 Mays
2,683,584 A * 7/1954 Selberg ..... E21B 7/02 242/125.1
2,822,066 A * 2/1958 Hanson ..... E04H 12/187 416/142
2,985,261 A 5/1961 Kubesh
3,315,422 A * 4/1967 McIntyre ..... E04H 12/34 52/116
3,749,183 A * 7/1973 Branham ..... E21B 15/00 173/151
3,803,780 A 4/1974 Donnally (Continued)

FOREIGN PATENT DOCUMENTS

GB 2055572 A 3/1981
GB 2330368 A 4/1999

(Continued)

OTHER PUBLICATIONS

Base-Hinged Column Manual—Data sheet No. 15A, www.towermaster.co.uk.

(Continued)

*Primary Examiner* — Brian Glessner
*Assistant Examiner* — Adam Barlow
(74) *Attorney, Agent, or Firm* — Marsh Fischmann & Breyfogle LLP; Jonathon A. Szumny

(57) ABSTRACT

Folding pole assemblies for erecting various types of items (e.g., flags, banners, sirens, etc.) as well as facilitating low-profile (e.g., covert, inconspicuous) access to the items after erection such as for maintenance, replacement, and/or the like. Each assembly includes at least one pole (e.g., mast, pillar, column, arm, etc.) that tilts (e.g., folds, pivots) away from a base member about a pivot axis disposed adjacent a bottom of the pole so that a substantial entirety of the pole remains on one side of the base member as the pole tilts between upright and tilted positions and/or between various tilted positions. This arrangement allows the base members of the disclosed folding pole assemblies to be placed adjacent walls and other structures so that the poles can tilt away from the walls and other structures in a perpendicular directions thereto.

16 Claims, 4 Drawing Sheets

(56) References Cited

U.S. PATENT DOCUMENTS

| | | | | |
|---|---|---|---|---|
| 3,977,139 | A | 8/1976 | Bryant | |
| 4,167,740 | A | 9/1979 | Shriver | |
| 5,782,042 | A | 7/1998 | Klein | |
| 6,782,667 | B2 | 8/2004 | Henderson | |
| 7,015,872 | B1 | 3/2006 | Little | |
| 7,557,771 | B1 | 7/2009 | Hodges | |
| 7,621,077 | B1 | 11/2009 | Perina et al. | |
| 2011/0283640 | A1 | 11/2011 | Miller | |
| 2014/0115977 | A1* | 5/2014 | Egan | E04H 12/345 52/116 |

FOREIGN PATENT DOCUMENTS

| | | | |
|---|---|---|---|
| JP | 2013-112467 | A | 6/2013 |
| WO | WO 2007009211 | A1 | 1/2007 |

OTHER PUBLICATIONS

Spitzlift Portable Crane, www.wikco.com\spitz.html, dated Dec. 5, 2013, 51 pages.

Wa2ETU—Current Station, home.windstream.net, 19 pages.

* cited by examiner

FOLDING TOWER POLE ASSEMBLIES

CROSS REFERENCE TO RELATED APPLICATION

This application claims priority from U.S. Patent Application No. 61/974,160, entitled "FOLDING POLE ASSEMBLIES," and filed on Apr. 2, 2014, the entire contents of which is incorporated herein in its entirety as if set forth in full.

BACKGROUND

1. Field of the Invention

This invention generally relates to poles and masts for supporting equipment thereon and, more particularly, to tiltable or foldable masts that can be lowered to facilitate repair or replacement of the equipment mounted thereon.

2. Relevant Background

It is commonplace to mount equipment such as antennas, cameras, and the like on poles, towers or other structures to locate the equipment at more optimal operating positions, away from passersby that may otherwise attempt to tamper with the equipment, and the like. When the mounted equipment needs servicing or maintenance, service personnel typically must use an aerial lift or the like to gain access to the equipment, climb the pole or tower, or lower the tower or pole to the ground (e.g., sometimes using a crane or the like). After the maintenance has been performed on the equipment, the service personnel must then lower the aerial lift, climb down the tower, or lift and reinstall the tower onto its foundation. Some poles and towers for mounting equipment are pivotable to facilitate access to equipment mounted on a portion thereof.

SUMMARY

Disclosed herein are tower pole assemblies for erecting various types of items (e.g., flags, banners, sirens, antennas, bat chirp counters, wind anemometers, cameras, street lights, wind generator heads, lightning strike counters, wind socks, etc.), as well as facilitating low-profile (e.g., covert, inconspicuous) access to the items after erection such as for maintenance, replacement, and/or the like. Each assembly includes at least one pole (e.g., mast, pillar, column, arm, etc.) that folds (e.g., tilts, pivots, hinges, swings) away from a base member about a pivot axis disposed adjacent a bottom of the pole so that a substantial entirety of the pole remains on one side of the base member as the pole tilts between upright and tilted positions and/or between various tilted positions. This arrangement allows the base members of the disclosed folding pole assemblies to be placed adjacent walls and other structures so that the poles can tilt away from the walls and other structures within a plane that is perpendicular to the wall and the like.

In one aspect, a tilting pole assembly is disclosed that includes a base member having a first reference plane that passes through first and second opposite ends thereof, a mast that is pivotally connected to the base member adjacent a first end of the mast at a pivot axis that is non-movable relative to the base member within a second reference plane between at least an upright position in which the mast is parallel to the first reference plane and a tilted position in which the mast is non-parallel to the first reference plane, and a winch that facilitates movement of the mast between the upright and tilted positions. The winch includes a crank, where the first end of the base member is disposed between the second end of the base member and the crank. The winch also includes a line connecting the crank to the mast and passing at least one of over and through the base member, where rotation of the crank in a first rotational direction facilitates movement of the mast from the tilted position into the upright position, and where rotation of the crank in an opposite second rotational direction facilitates movement of the mast into the tilted position from the upright position. The first and second reference planes are perpendicular and at least a substantial entirety of the mast remains on one side of the first reference plane when the mast pivots between the upright and tilted positions.

In one arrangement, the line may pass through the first and second opposite ends of the base member. In another arrangement, the mast may include a portion that is parallel to the first reference plane when the mast is in the upright position, and where the portion remains on the one side of the first reference plane when the mast pivots between the upright and tilted positions. In a further arrangement, the base member of the assembly may be secured to a wall so that the first reference plane is one of parallel or substantially parallel to the wall.

In another aspect, a method disclosed herein includes securing a base member of an assembly to a wall, where the assembly includes a mast including a first end and a second end that is opposite to the first end, where the mast is pivotally connected to the base member adjacent the first end of the mast at a pivot axis that is non-movable relative to the base member, where the mast is pivotable about the pivot axis between at least an upright position in which the mast is parallel to the wall and a tilted position in which the mast is non-parallel to the wall. The disclosed method also includes securing a crank to the wall below the base member, threading a line of the crank through the base member, and securing the line relative to the mast. Rotation of the crank in a first rotational direction facilitates movement of the mast from the tilted position into the upright position and rotation of the crank in an opposite second rotational direction facilitates movement of the mast into the tilted position from the upright position.

In a further aspect, a method disclosed herein includes rotating a handle to wind a line onto a drum of a winch secured to a wall that is disposed along a first reference plane; and pivoting, in response to the rotating, a mast about a pivot axis and along a second reference plane that is perpendicular to the first reference plane, where the pivot axis is parallel and non-movable relative to the first reference plane.

In one arrangement, the method may further include inducing, in response to the rotating, sliding of the line through a base member secured to the wall. For instance, the base member may be spaced from the winch. In another arrangement, the pivoting may include pulling the mast into an upright position in which the mast is parallel to the second reference plane. For instance, the wall may include a first end adjacent a ground surface and an opposite second free end at a first height above the ground surface, where the mast includes a first end adjacent the pivot axis and an opposite second end, and where the second end of the mast is disposed at a second height greater than the first height when the mast is in the upright position.

In yet another aspect disclosed herein, a wall assembly includes a wall, a tilting pole assembly having a base member attached to the wall and a mast pivotally interconnected with the base member, and an attachment interconnected with the mast, where the attachment is disposed at a higher elevation than an upper end of the wall when the mast in disposed in a fully deployed position, and where the attachment is disposed at a lower elevation than the upper end of the wall when the mast in disposed in a fully refracted position. The mast is pivotable away from and toward the wall through a range of motion of at least about 30 degrees. Furthermore, the tilting pole assembly includes a positioning mechanism interconnected with the mast that facilitates the pivotal movement of the mast at least one of away from and towards the wall.

In still another aspect disclosed herein a tilting pole assembly includes a wall, a base member positioned adjacent the wall and having first and second base ends, a mast pivotally interconnected with the base member on a first side of the base member, an attachment interconnected with the mast; and a positioning mechanism incorporated by the base member and interconnected with the mast, where the positioning mechanism includes a hand-operated actuator that is disposed on a second side of the base member that is opposite of the first side. The first base end includes an anchoring flange and the second base end is disposed at a higher elevation than the first base end when the anchoring flange is disposed on a supporting surface. Furthermore, the mast is pivotable relative to the base member through a range of motion of at least about 30 degrees in a manner that is free of contact with the wall.

In addition to the exemplary aspects and embodiments described above, further aspects and embodiments will become apparent by reference to the drawings and by study of the following descriptions.

DETAILED DESCRIPTION

Disclosed herein are tower pole assemblies for erecting various types of items (e.g., flags, banners, sirens, antennas, bat chirp counters, wind anemometers, cameras, street lights, wind generator heads, lightning strike counters, wind socks, etc.), as well as facilitating low-profile (e.g., covert, inconspicuous) access to the items after erection such as for maintenance, replacement, and/or the like. Each assembly includes at least one pole (e.g., mast, pillar, tower, column, arm, etc.) that folds (e.g., tilts, pivots, hinges, swings) away from a base member about a pivot axis disposed adjacent a bottom of the pole so that a substantial entirety of the pole remains on one side of the base member as the pole tilts between upright and tilted positions and/or between various tilted positions. This arrangement allows the base members of the disclosed folding pole assemblies to be placed adjacent walls and other structures so that the poles can tilt away from the walls and other structures within a plane that is perpendicular to the wall and the like.

Figure 1:
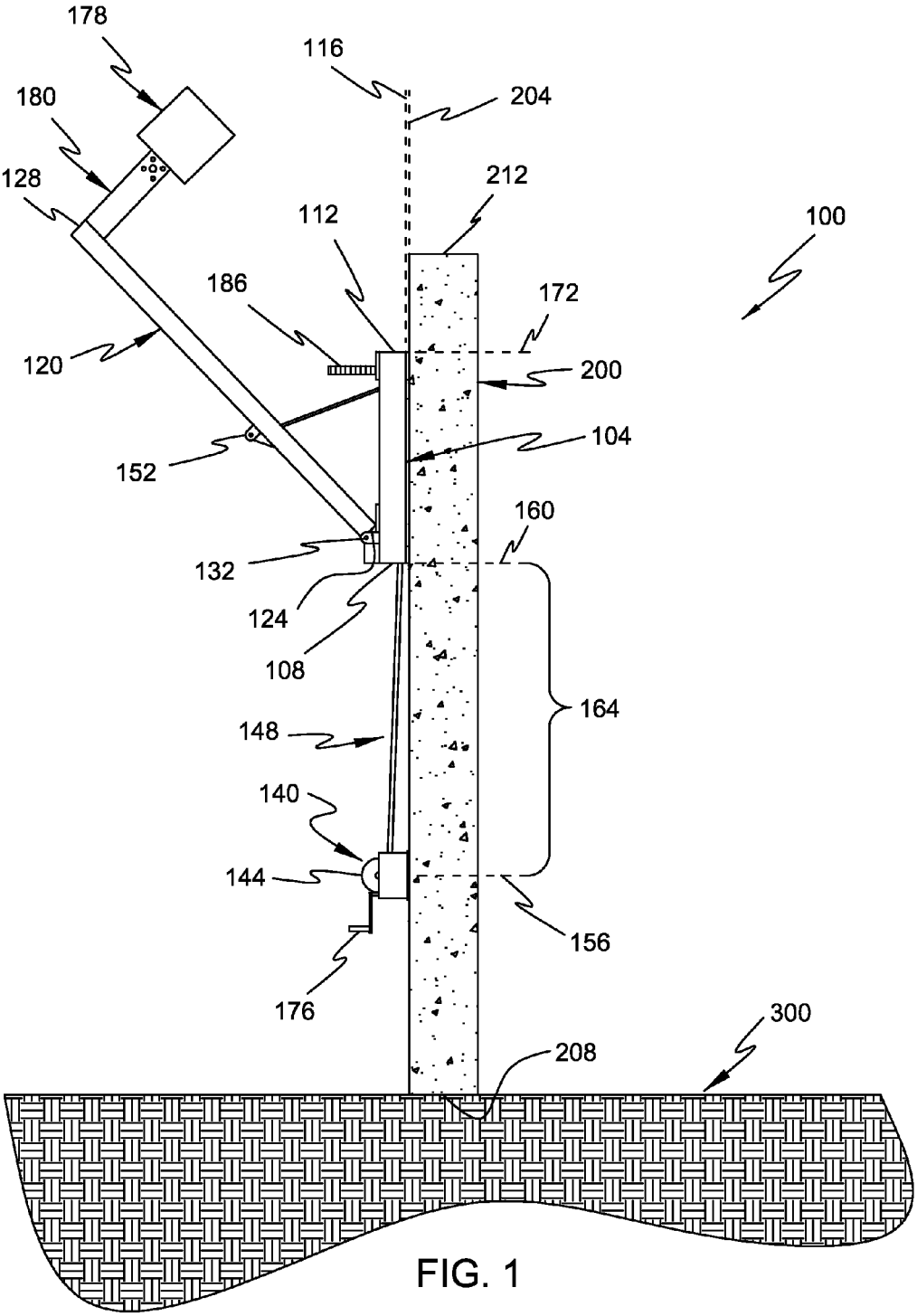
FIG. 1 is a side/elevation view of a folding pole assembly according to one embodiment, where a mast of the assembly is in a tilted position with respect to a base member of the assembly.

FIG. 1 is a side/elevation view of a tower pole assembly 100 according to one embodiment disclosed herein. The folding pole assembly 100 broadly includes a base member 104 (e.g., bracket, brace, pillar, column, etc. of any appropriate material, shape, length and/or cross-section, such as I-shaped, square-shaped, etc.) including a first end 108, and a second end 112 that is opposite to the first end 108. A reference plane 116 passes through the first and second opposite ends 108, 112. The folding pole assembly 100 also includes a mast 120 (e.g., pole, column, pillar, etc. of any appropriate material, shape, length and/or cross-section, such as I-shaped, square-shaped, etc.) including first and second opposite ends 124, 128. The mast 120 and base member 104 are appropriately pivotally or hingedly connected (e.g., via hinge, pivot pins, bolts, nuts, bearings, etc.) adjacent the first end 108 of the base member 104 and adjacent the first end 124 of the mast 120 at/about a pivot axis 132 that is parallel to the reference plane 116 and non-movable relative to the base member 104 (i.e., the pivot axis 132 is non-displaceable relative to the base member 104).

Figure 4:
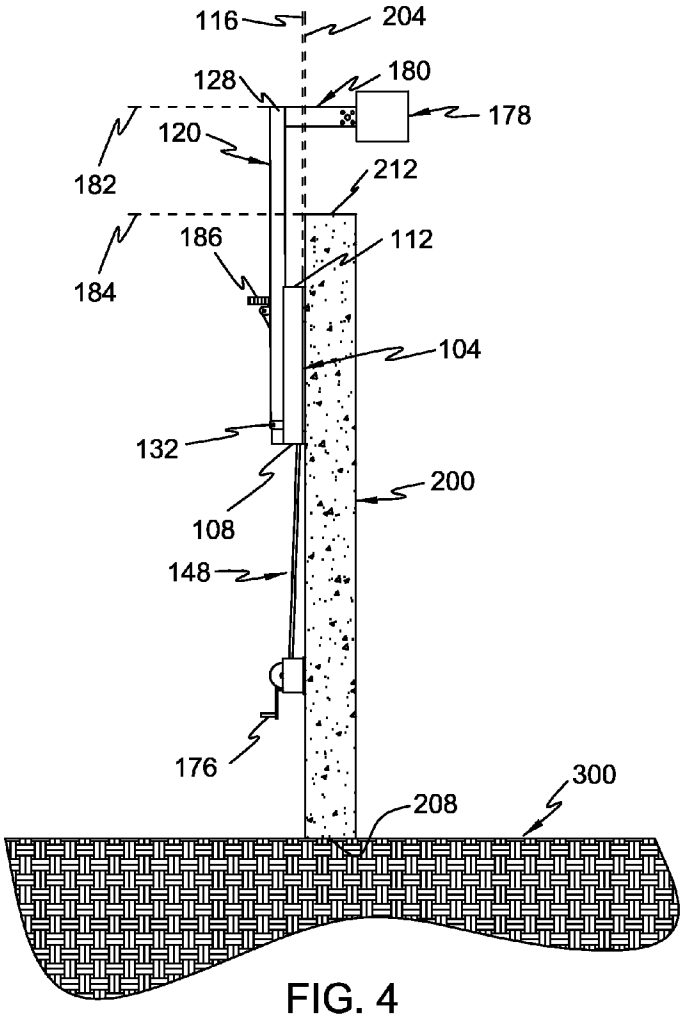
FIG. 4 is a side/elevation view similar to FIG. 1, but with the mast in an upright position with respect to the base member of the assembly.
Figure 3:
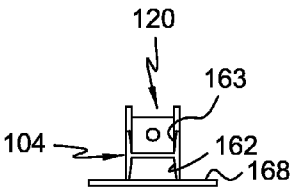
FIG. 3 is a bottom view of a portion of the folding pole assembly of FIG. 1.
Figure 2:
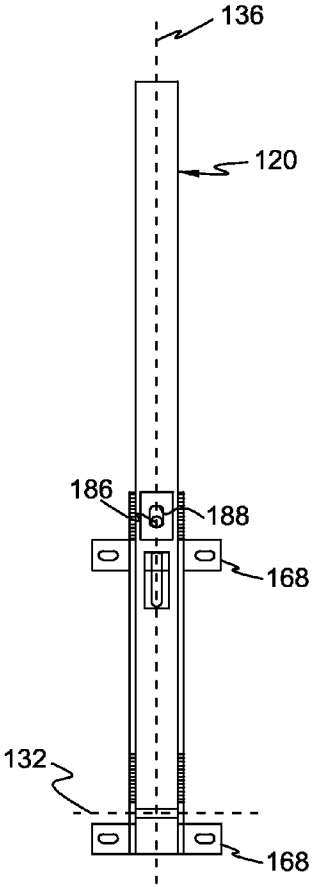
FIG. 2 is a front view of a portion of the folding pole assembly of FIG. 1, but with the mast in an upright position with respect to the base member of the assembly.
Figure 5:
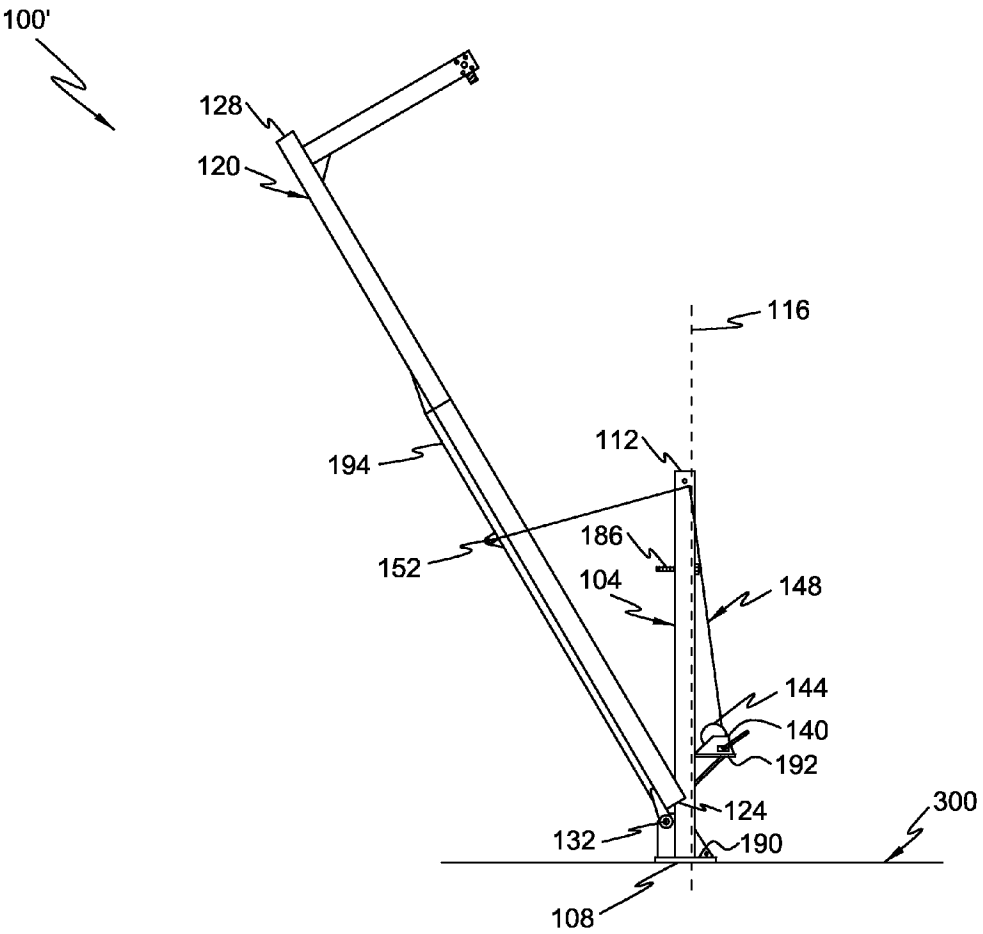
FIG. 5 is a side/elevation view of a folding pole assembly according to another embodiment.
Figure 6:
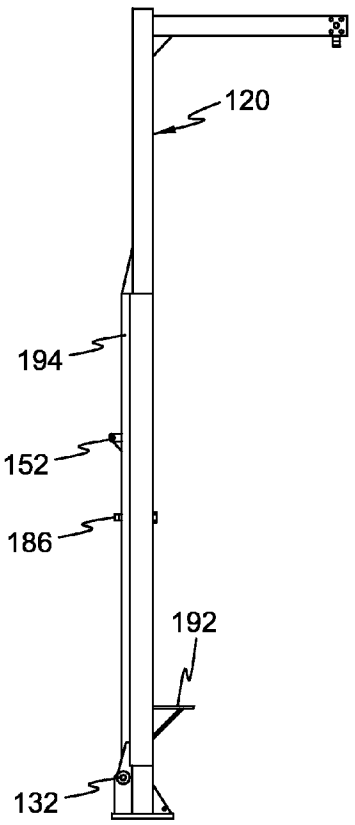
FIG. 6 is one side/elevation view of the folding pole assembly of FIG. 5, but with the mast in an upright position with respect to the base member of the assembly.
Figure 7:
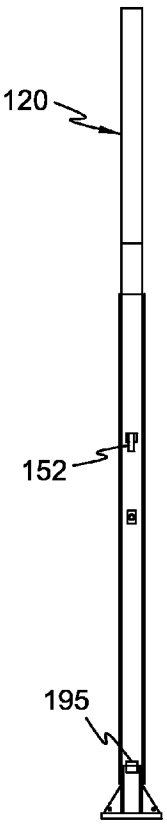
FIG. 7 is a rear view of the folding pole assembly of FIG. 5 (upright position).
Figure 8:
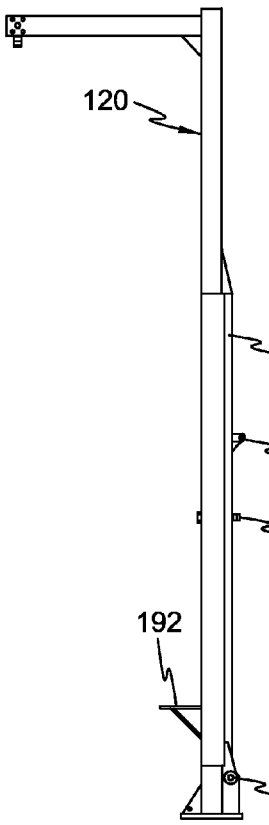
FIG. 8 is the other side/elevation view of the folding pole assembly of FIG. 5 (upright position).
Figure 9:
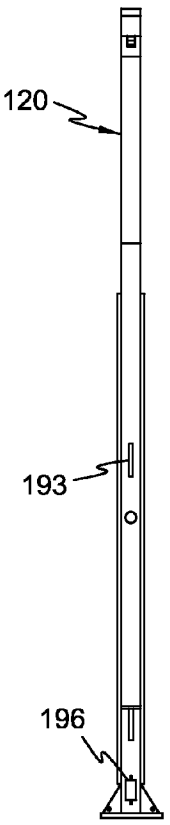
FIG. 9 is a front view of the folding pole assembly of FIG. 5 (upright position).

The mast 120 is foldable (e.g., tiltable, pivotable, hingeable, etc.) about the pivot axis 132 between one or more tilted positions (e.g., as shown in FIG. 1) whereby the mast 120 is non-parallel to the reference plane 116, and an upright position (e.g., as shown in FIG. 4) whereby the mast 120 is substantially parallel to the reference plane 116. With reference to FIGS. 1, 2 and 4, it can be seen how the mast 120 is configured to swing (e.g. pivot, tilt, etc.) within a reference plane 136 that is perpendicular to the reference plane 116 (e.g., whereby the pivot axis 132 is perpendicular to the reference plane 136, see FIG. 3). When the base member 104 is secured to a surface of a wall 200 (e.g., vertical wall) such that the reference plane 116 is substantially or fully parallel to a reference plane 204 of the surface of the wall 200, the reference plane 136 within which the mast 120 swings may also be perpendicular to the reference plane 204 of the surface of the wall.

With reference to FIGS. 1 and 2, it can be seen how all or at least a substantial entirety of the mast 120 (e.g., between the first and second ends 124, 128) remains on one side of the reference plane 116 between the tilted position of FIG. 1 and the upright position of FIG. 4. More particularly, all or at least a substantial entirety of the mast 120 (e.g., such as a portion of the mast 120 between the first and second ends 124, 128 that is configured to be in a vertical orientation and/or parallel to the reference plane 116 when in the upright position of FIG. 4) remains on one side of the reference plane 116 because the mast 120 is pivotally connected to the base member 104 adjacent a bottom (e.g., first end 124) of the mast 120 (as opposed to the mast 120 being pivotally connected to the base member 120 at an intermediate portion of the mast 120 whereby the portion of the mast 120 between the intermediate portion and the first end 124 would be urged to swing past the reference plane 116 to an opposite second side of the reference plane 116). This arrangement allows the base member 104 to be secured to the wall 200 (e.g., vertical wall) residing within or including the reference plane 204 so that the mast 120 can swing (e.g. pivot, tilt, etc.) within or parallel to the reference plane 136 that is perpendicular to the reference planes 116, 204. More particularly, the wall 200 would otherwise inhibit swinging movement of the mast 120 within the reference plane 136 in the event the mast 120 was pivotally connected to the base member 104 at an intermediate position of the mast 120 (e.g., because the portion of the mast 120 between the intermediate portion and the first end 124 would abut or contact the wall 200).

The folding pole assembly 100 may include any appropriate positioning mechanism or the like interconnected with the mast 120 to facilitate movement of the mast 120 about the pivot axis 132 within reference plane 136 between the upright position and tilted positions, as well as between various tilted positions. For instance, the positioning mechanism may be in the form of a winch assembly 140 that may be appropriately secured to the wall 200, and that includes a crank 144 (e.g., actuator) and at least one line 148 (e.g., cable, cord, wire) that is secured between the crank 144 and the mast 120. The line 148 is configured to slidingly move in first and second opposite directions to move and/or allow for movement of the mast 120 about the pivot axis 132. For instance, the line 148 may be appropriately wound around a drum (e.g., spindle, not labeled) of the crank 144, pass through at least a portion of the base member 104, and connect to a portion of the mast 120 (e.g., such as at a line termination bracket 152 of the mast 120 or the like). While the figures illustrate the line 148 being secured to the mast 120 between the first and second ends 124, 128, other embodiments include the line 148 being secured to the mast 120 at or adjacent the second end 128.

With reference to FIGS. 1 and 2, the wall 200 may include a first end 208 secured to or adjacent a ground surface 300 (e.g., horizontal surface, such as the earth, an artificial foundation such as concrete, and/or the like) and an opposite second free end 212 distal from the ground surface 300. In one arrangement, the crank 144 may be secured to the wall 200 at one height 156 above the ground surface 300, and the first end 108 of the base member 104 may be secured to the wall 200 at another height 160 above the ground surface 300 that is greater than the height 156 of the crank 144 such that the crank 144 is spaced from the first end 108 by a distance 164. For instance, the line 148 may, after leaving the crank 144, enter a cavity 162 of the base member 104 (labeled in FIG. 3) via an opening at the first end 108 of the base member 104, and travel at least partially through the cavity 162 in a direction towards the second end 112 of the base member 104 (e.g., so that the line 148 is at least partially concealed within the base member 104). In one arrangement, the line 148 may pass over or through at least one or more appropriate guides (e.g., pulleys, blocks, holes, etc., not shown) disposed at any appropriate location in or on the base member 104 (e.g., near or adjacent the second end 112 of the base member 104, such as within the cavity 162 of the base member 104) for purposes of obtaining any appropriate mechanical advantage useful to pull the mast 120 towards the base member 104. After passing over or through the guide, the line 148 may travel to the mast 120 and terminate at the termination bracket 152 (or other securement mechanism on the mast 120).

To secure the folding pole assembly 100 to the wall 200, the base member 104 may be secured to the wall 200 so that the reference plane 116 is substantially parallel to the reference plane 204 of the wall 200. For instance, fasteners (e.g., bolts, screws, etc.) may be inserted through holes in the base member 104 (e.g., holes through mounting flanges and/or brackets 168 or the like of the base member 104) and into corresponding holes in the wall 200. Additionally, the crank 144 may be secured to the wall 200 in any appropriate manner (e.g., fasteners or the like). The line 148 may be threaded through the base member 104 and secured to the mast 120 before or after the base member 104 and crank 144 are secured to the wall 200. In any event, the height 160 of the first end 108 of the base member 104 is greater than the height 156 of the crank 144 and below a height 172 of the second end 112 of the base member 104 after the base member 104 and crank 200 have been secured to the wall 200. Stated differently, the first end 108 of the base member 104 is disposed between the crank 144 and the second end 112 (and the guide). The line 148 may be wound about the crank 144, passed through the base member 104 and the one or more guides, and attached to the mast 120 in any appropriate manner before or after the crank 144 and base member 104 have been secured to the wall 200.

In use, the drum of the crank 144 may be rotated (e.g., via handle 176) in one of first and second opposite rotational directions to lower the mast 120 so that the second end 128 is accessible to an operator on the ground surface 300 (e.g., which may be a tilted position lower than that shown in FIG. 1, such as where an angle between the mast 120 and the reference plane 116 of the base member 104 is almost any angle up to 180°). In one arrangement, the operator may grasp handle 176 and control the unwinding of the line 148 from the drum of the crank 144 owing to the weight of the mast 120 pulling the line 148 through and away from the base member 104. In another arrangement, the crank 144 may include any appropriate braking mechanism or the like configured to automatically control the unwinding of the line 148 from the crank 144 as the weight of the mast 120 acts to pull the line 148 away from the base member 104. For instance, the braking mechanism may serve to automatically maintain the mast 120 in any appropriate tilted position (e.g., such as that shown in FIG. 1) absent an operator rotating the crank 144 in the rotational direction that unwinds the line 148 from the drum of the crank 144 (e.g., where the operator may need to overcome any appropriate level of resistance enacted on the drum by the braking mechanism). Additionally or alternatively, the crank 144 may include any appropriate locking mechanism that may be manipulated by the operator to temporarily prevent or at least reduce the likelihood of the rotation of the crank in either of the first or second rotational directions and thus maintain the mast 120 in a desired position. One or more ratcheting mechanisms may also be used in relation to the crank 144.

In any event, the operator may mount or load one or more items or attachments 178 (e.g., security camera(s), antenna(s), etc.) onto the mast 120 (e.g., adjacent or near the second end 128) in any appropriate manner (e.g., fasteners, clamps, etc.). In one arrangement, at least one mounting arm or bracket 180 (e.g., including one or more apertures, not labeled) or the like may be disposed on the second end 128 of the mast 120 for use in securing one or more attachments 178 to the mast 120. For instance, the one or more attachments 178 may be detachably connectable with the mounting arm 180 and/or with the mast 120 such that the attachment(s) 178 may be removed from the mast 120 free of damaging the mast 120 and such that the attachment(s) 178 may be disposed in a fixed position relative to said mast 120. In one arrangement, the mounting arm 180 may not be considered part of the mast 120 and may be, for instance, a separate piece or component that is secured to the second end 128 of the mast 120.

In any event, the operator may, after one or more items have been appropriately secured to the mast 120, rotate the handle 176 of the crank 144 in the other of the first and second opposite rotational directions to wind the line 148 onto the drum of the crank 144 and thereby pull the mast 120 (e.g., via termination member 152 or the like of mast 120) towards the base member 104 (e.g., about pivot axis 132) into the upright position of FIG. 4 in which the mast 120 is generally parallel or actually parallel to the reference planes 116, 204. For instance, the mast 120 may be pivotable away from and toward the wall 200 (e.g., free of contact with the wall 200) through a range of motion of at least about 180 degrees. As shown, the attachment 178 may be disposed at an elevation higher than that of the second (e.g., upper) end 212 of the wall 200 when the mast 120 is disposed in the upright (e.g., fully deployed) position (see FIG. 4). In one arrangement, the attachment 178 may be disposed at an elevation lower than that of the second end 212 of the wall 200 when the mast 120 is disposed in at least one of the tilted positions (e.g., a fully retracted position). In another arrangement, the mast 120 may be at least partially received in a cavity 163 of the base member 104 in the upright position of the mast 120. In a further arrangement, the base member 104 may be at least partially received in a cavity (not shown) of the mast 120 in the upright position of the mast 120.

In one variation, any appropriate hardware for and/or manner of preventing or at least reducing the likelihood of the mast 120 moving away from the base member 104 into a tilted position may be incorporated into the folding pole assembly 100. As one example, at least one locking member in the form of a threaded bolt 186 or the like on the base member 104 may be configured to correspondingly engage with at least one locking member in the form of an opening 188 of the mast 120. For instance, the opening 188 may be configured to receive the bolt 186 when the mast 120 moves into the upright position of FIG. 4. Thereafter, a nut or the like may be threaded onto the end of the bolt 186 to prevent or at least reduce the likelihood of the mast 120 moving away from the base member 104 into a tilted position. As another example, one or more clamps, brackets, and/or the like may be disposed over the outside of the mast 120 and appropriately secured to the base member 104 and/or wall 200 to prevent or at least reduce the likelihood of the mast 120 moving away from the base member 104 into a tilted position. Other manners of locking the mast 120 against movement away from the upright position are also envisioned and encompassed herein.

In the upright position, the second end 128 of the mast 120 may be disposed at a height 182 above the ground surface 300 greater than a height 184 of the second free end 212 of the wall 200 so that the one or more items (not shown) secured to the second free end 128 and/or mounting arm 180 may also be disposed at a height greater than the height 184 of the second free end 212 of the wall 200. For instance, a security camera mounted adjacent the second end 128 of the mast 120 may, in the upright position of the mast 120 of FIG. 4, have a field of view that includes the scene on an opposite side of the wall 200 from which the base member 104 was mounted. Furthermore, the items (e.g., the security camera or the like) may be accessed for repair, replacement, and/or the like (e.g., via rotating the handle 176 in the one of the first and second rotational directions to lower the mast 120) on inside of the wall 200 free of having to expose the operator or technician above the second end 212 of the wall 200 and thus the scene on the opposite side of the wall 200. While the height 182 of the second end 128 of the mast 120 has been shown and described as being above the height 184 of the second end 212 of the wall 200 in the upright position, the height 182 of the second end 128 of the mast 120 may, in other arrangements encompassed herein, be disposed lower than the height 184 of the second end 212 of the wall 200 in the upright position (e.g., such as by selecting a mast 120 with an appropriate length, mounting the base member 104 at an appropriate location on the wall 200, and/or the like).

FIGS. 5-9 illustrate another embodiment of the folding pole assembly and is identified by reference numeral 100'. As the folding pole assembly 100' of FIGS. 5-9 is at least generally in accordance with the folding pole assembly 100 of FIGS. 1-4, the discussion of the embodiment of FIGS. 1-4 is substantially equally applicable to the embodiment of FIGS. 5-9. Corresponding components between the embodiments of FIGS. 1-4 and 5-9 are identified by the same reference numeral. Those corresponding components that differ in at least some respect are identified by a single prime (').

The base member 104' of the folding pole assembly 100' is configured to be mounted on and/or secured to the ground surface 300 rather than to a surface of a wall (e.g., wall 200 as in the folding pole assembly 100 of FIGS. 1-4) in any appropriate manner. In one arrangement, a mounting flange or plate 190 or the like may be appropriately secured to or adjacent the first end 108 of the base member 104 for appropriate placement on or adjacent the ground surface 300. For instance, a number of fasteners (e.g., bolts or the like) may be inserted through respective apertures of the mounting plate 190 and into corresponding holes in a concrete pad or the like disposed on the ground surface 300. In one arrangement, the folding pole assembly 100' may be placed next to or adjacent a wall (e.g., wall 200) so that the mast 120 is pivotable relative to the base member (e.g., and the wall 200) along or parallel to a plane that is perpendicular to the wall through a range of motion of at least about 30 degrees (e.g., such as at least about 60 degrees, or at least about 90 degrees) in a manner that is free of contact with the wall. Furthermore, the crank 144 of the winch 140 may be secured to the base member 104 rather than secured to a wall and spaced from the base member 104' (as in the folding pole assembly 100 of FIGS. 1-4). As just one example, another mounting plate 192 may be appropriately secured to the base member 104 onto which the crank 144 may be appropriately secured (e.g., bolts and holes, welding, etc.). For instance, the mounting plate 192 (e.g., and/or the crank 144 and/or other hand-operated actuator) may be secured to or adjacent one side of the base member 104' while the pivot axis 132 may be non-movably secured to or adjacent an opposite second side of the base member 104'. In one arrangement, a distance between the second side of the base member 104' (e.g., the side to which the crank 144 is attached or secured relative to) and the wall may be not greater than about 6 inches such as not greater than about 1 inch.

After leaving the crank 144, the line 148 may travel upwards towards the second end 112 of the base member 104', through an aperture 193 (e.g., slot, passage, hole) in the base member 104', and then to the mast 120 (e.g., whereby the line 148 may be appropriately secured to a portion of the mast 120 between the first and second ends 124, 128 of the mast 120, such as at termination bracket 152 or the like). For instance, the line 148 may pass over or through one or more appropriate guides (e.g., pulleys, blocks, holes, etc., not shown) disposed at any appropriate location in or on the base member 104' (e.g., near or adjacent the second end 112, such as within a cavity of the base member 104') before traveling to the mast 120.

In one arrangement, the folding pole assembly 100' may include any appropriate arrangement to facilitate passage of cables, cords, etc. (e.g., for power, communication, etc.) to one or more items mounted to the mast 120. For instance, the mast 120 may include one or more routing channels 194 disposed along at least a portion thereof between the first and second ends 124, 128 along or through which cables, cords, etc. may be routed and passed for supplying power to the items and/or facilitating communications between the items and one or more computing devices and/or networks. In one variation, an inlet 196 (e.g., slot, aperture, etc.) may be disposed through a portion of the mast 120 that leads into the one or more routing channels 194. Additionally or alternatively, an access hole 195 (e.g., and cover) may be disposed through base member 104' to facilitate access to an interior of the base member 104' and/or to the routing channels 194 of the mast 120. While not illustrated, any appropriate arrangement to facilitate routing and/or passage of cables, cords, and/or the like may also be incorporated into the folding pole assembly 100 of FIGS. 1-4.

It will be readily appreciated that many additions and/or deviations may be made from the specific embodiments disclosed in the specification without departing from the spirit and scope of the invention. In one arrangement, the base member 104 of the folding pole assembly 100 of FIGS. 1-4 may extend towards or to the crank 144 so as to substantially conceal the entirety of the line 148 between the crank 144 and the second end 112 of the base member 104 (or otherwise where the line 148 exits the base member 104 towards the mast 120). For instance, the crank 144 may be secured to the first end 108 of the base member 104. In another arrangement, the pivot axis 132 may be disposed between the first and second ends 108, 112 of the base member 104 (e.g., such as at a mid-point of the base member 104). In a further arrangement, the masts 120 of the folding pole assemblies 100, 100' may be telescoping or otherwise adjustable along their lengths.

Still further, the cranks 144 of the winches 140 may be motorized to facilitate movement of the mast 120 towards and away from the base members 104, 104'. In a still further arrangement, the pivot axis 132 may be spaced from the base member 104 (and thus from the wall 200) by any appropriate extension arm or bracket (e.g., where the extension arm extends perpendicularly to the reference planes 116, 204). For instance, the extension arm may be configured to space the pivot axis 132 at least about 3 feet from the base member 120 and the wall 200, such as at least about 6 feet. Among other advantages, this arrangement may allow the mast 120 to swing at least partially past a parallel position relative to the reference plane 116 of the base member and the reference plane 204 of the wall 200 (e.g., at least partially in a clockwise direction relative to the position of the mast 120 shown in FIG. 4).

Any of the embodiments, arrangements, or the like discussed herein may be used (either alone or in combination with other embodiments, arrangement, or the like) with any of the disclosed aspects. Merely introducing a feature in accordance with commonly accepted antecedent basis practice does not limit the corresponding feature to the singular. Any failure to use phrases such as "at least one" does not limit the corresponding feature to the singular. Use of the phrase "at least generally," "at least partially," "substantially" or the like in relation to a particular feature encompasses the corresponding characteristic and insubstantial variations thereof. Furthermore, a reference of a feature in conjunction with the phrase "in one embodiment" does not limit the use of the feature to a single embodiment. Still further, any use of "first," "second," "third," etc. herein does not necessarily connote any specific order or arrangement of components and/or processes disclosed herein and has merely be used to facilitate understanding of the teachings presented herein.

While this specification contains many specifics, these should not be construed as limitations on the scope of the disclosure or of what may be claimed, but rather as descriptions of features specific to particular embodiments of the disclosure. Furthermore, certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations, one or more features from a claimed combination can in some cases be excised from the combination, and the claimed combination may be directed to a subcombination or variation of a subcombination.

Similarly, while operations may be depicted in the drawings in a particular order, this should not be understood as requiring that such operations be performed in the particular order shown or in sequential order, or that all illustrated operations be performed, to achieve desirable results. In certain circumstances, multitasking and/or parallel processing may be advantageous. Moreover, the separation of various system components in the embodiments described above should not be understood as requiring such separation in all embodiments, and it should be understood that the described program components and systems can generally be integrated together in a single software and/or hardware product or packaged into multiple software and/or hardware products.

The above described embodiments including the preferred embodiment and the best mode of the invention known to the inventor at the time of filing are given by illustrative examples only.

The invention claimed is:

1. A tilting pole assembly, comprising:

a base member including a first end, a second end that is opposite to the first end, and a first reference plane that passes through the first and second opposite ends of the base member;

a mast including a first end and a second end that is opposite to the first end, wherein the mast is pivotally connected to the base member adjacent the first end of the mast at a pivot axis, wherein the pivot axis is non-movable relative to the base member, wherein the mast is pivotable about the pivot axis within a second reference plane between at least an upright position in which the mast is parallel to the first reference plane and a tilted position in which the mast is non-parallel to the first reference plane, wherein the first reference plane is perpendicular to the second reference plane, and wherein a majority of the mast remains on one side of the first reference plane when the mast pivots between the upright and tilted positions; and a winch that facilitates movement of the mast between the upright and tilted positions, wherein the winch includes:

a crank, wherein the first end of the base member is disposed between the second end of the base member and the crank; and a line connecting the crank to the mast and passing at least one of over and through the base member, wherein rotation of the crank in a first rotational direction facilitates movement of the mast from the tilted position into the upright position, and wherein rotation of the crank in an opposite second rotational direction facilitates movement of the mast into the tilted position from the upright position.

2. The assembly of claim 1, wherein the line passes through a majority of a distance between the first and second opposite ends of the base member.

3. The assembly of claim 1, wherein the mast includes a portion that is parallel to the first reference plane when the mast is in the upright position, and wherein the portion remains on the one side of the first reference plane when the mast pivots between the upright and tilted positions.

4. The assembly of claim 1, wherein the base member further includes a first locking member, wherein the mast further includes a second locking member, and wherein the first and second locking members are configured to engage in the upright position of the mast to limit movement of the mast into the tilted position.

5. The assembly of claim 1, wherein the line is secured to the mast at a location that is between the first and second opposite ends of the mast.

6. The assembly of claim 1, wherein the crank is spaced from the base member.

7. The assembly of claim 1, wherein the pivot axis is parallel to the first reference plane.

8. The assembly of claim 1, wherein the pivot axis is perpendicular to the second reference plane.

9. The assembly of claim 1, wherein the pivot axis is disposed adjacent the first end of the base member.

10. The assembly of claim 1, wherein the base member includes a cavity between the first and second opposite ends of the base member, and wherein the mast is at least partially received in the cavity in the upright position.

11. The assembly of claim 1, wherein the first reference plane passes through the crank.

12. The assembly of claim 4, wherein the first end of the base member is positioned between the first locking member and the crank.

13. The assembly of claim 1, wherein the first end of the base member is positioned between the first end of the mast and the crank when the mast is in the upright position.

14. The assembly of claim 1, wherein the entirety of the mast remains on the one side of the first reference plane when the mast pivots between the upright and tilted positions.

15. A tilting pole assembly, comprising:

a base member including a first end, a second end that is opposite to the first end, and a first reference plane that passes through the first and second opposite ends of the base member;

a mast including a first end and a second end that is opposite to the first end, wherein the mast is pivotally connected to the base member at the first end of the mast at a pivot axis, wherein the pivot axis is non-movable relative to the base member, wherein the mast is pivotable about the pivot axis within a second reference plane between at least an upright position in which the mast is parallel to the first reference plane and a tilted position in which the mast is non-parallel to the first reference plane, wherein the first reference plane is perpendicular to the second reference plane, and wherein a majority of the mast remains on one side of the first reference plane when the mast pivots between the upright and tilted positions; and a winch that facilitates movement of the mast between the upright and tilted positions, wherein the winch includes:

a crank, wherein the first end of the base member is disposed between the second end of the base member and the crank; and a line connecting the crank to the mast and passing at least one of over and through the base member, wherein rotation of the crank in a first rotational direction facilitates movement of the mast from the tilted position into the upright position, and wherein rotation of the crank in an opposite second rotational direction facilitates movement of the mast into the tilted position from the upright position.

16. A tilting pole assembly, comprising:

a base member including a first end, a second end that is opposite to the first end, and a first reference plane that passes through the first and second opposite ends of the base member;

a mast including a first end and a second end that is opposite to the first end, wherein the mast is pivotally connected to the base member adjacent the first end of the mast at a pivot axis, wherein the pivot axis is non-movable relative to the base member, wherein the mast is pivotable about the pivot axis within a second reference plane between at least an upright position in which the mast is parallel to the first reference plane and a tilted position in which the mast is non-parallel to the first reference plane, wherein the first reference plane is perpendicular to the second reference plane, and wherein a majority of the mast remains on one side of the first reference plane when the mast pivots between the upright and tilted positions; and a winch that facilitates movement of the mast between the upright and tilted positions, wherein the winch includes:

a crank, wherein the first end of the base member is disposed between the second end of the base member and the crank; and a line connecting the crank to the mast and passing through the base member, wherein rotation of the crank in a first rotational direction facilitates movement of the mast from the tilted position into the upright position, and wherein rotation of the crank in an opposite second rotational direction facilitates movement of the mast into the tilted position from the upright position.

* * * * *